US008708295B2

(12) United States Patent
Barthelmie et al.

(10) Patent No.: US 8,708,295 B2
(45) Date of Patent: Apr. 29, 2014

(54) WORKPIECE-CARRIER

(75) Inventors: Martin Barthelmie, Hohenahr (DE); Arno Cloos, Meschede (DE); Michael Riedl, Biebertal (DE)

(73) Assignee: GTD Graphit Technologie GmbH, Langgons (DE)

( * ) Notice: Subject to any disclaimer, the term of this patent is extended or adjusted under 35 U.S.C. 154(b) by 0 days.

(21) Appl. No.: 13/388,145

(22) PCT Filed: Aug. 13, 2010

(86) PCT No.: PCT/EP2010/061838

§ 371 (c)(1),
(2), (4) Date: Jan. 31, 2012

(87) PCT Pub. No.: WO2011/018516

PCT Pub. Date: Feb. 17, 2011

(65) Prior Publication Data

US 2012/0138765 A1 Jun. 7, 2012

(30) Foreign Application Priority Data

Aug. 14, 2009 (DE) ..... 10 2009 037 293

(51) Int. Cl.

| | |
|---|---|
| ***A47B 91/00*** | (2006.01) |
| ***A47G 29/00*** | (2006.01) |
| ***B65D 19/00*** | (2006.01) |
| *F27D 1/04* | (2006.01) |
| *F27D 5/00* | (2006.01) |
| *C21D 9/00* | (2006.01) |

(52) U.S. Cl.
USPC ..... 248/346.02; 432/249; 432/253; 432/261

(58) Field of Classification Search
USPC ..... 248/346.01, 346.02, 901; 432/261, 258
See application file for complete search history.

(56) References Cited

U.S. PATENT DOCUMENTS 2,605,092 A * 7/1952 Hutchinson et al. ..... 432/241
(Continued)

FOREIGN PATENT DOCUMENTS

DE 103 12 802 B3 7/2004

*Primary Examiner* — Jonathan Liu
*Assistant Examiner* — Taylor Morris
(74) *Attorney, Agent, or Firm* — Matthias Scholl, PC; Matthias Scholl

(57) ABSTRACT

Improved workpiece-carrier in the form of a high-temperature-grating 10 assembled from mutually engaging elements consisting of carbon-fiber-reinforced carbon-composite-board-strips comprising comb-shaped elements, having a frame surrounding a horizontal grating as well as at least one workpiece-support (40) which is inert in relation to the supported workpiece and provides a workpiece-support-area (50) at a distance above the grating (3O)7 said work-piece-support (40) being arranged within at least one enclosing cut-out-section of at least one element wherein furthermore said elements comprise at least one element having interlocking cut-out-sections in alternating arrangement, at least one auxiliary element, said workpiece-support (40) is a single-piece part of high temperature ceramic of rod-shaped elongation being arranged parallel to the plane of said grating (30) and being an integral part of the grating by being enclosed beneath the workpiece-support-area (50) by cut-out-sections of a multitude of crosswise arranged grating-elements while also being framed at its ends by crosswise arranged continuous elements, the enclosed, non-removable work-piece-support being floatingly integrated within the grating and the workpiece-carrier being fastened in assembled position by the at least one auxiliary element, wherein each comb-shaped element has at least one auxiliary bore with an auxiliary element arranged tightly and form-fittingly in said auxiliary bore and each auxiliary element being furthermore arranged tightly and form-fittingly in at least one auxiliary bore of the at least one element having interlocking cut-out-sections in alternating arrangement.

19 Claims, 7 Drawing Sheets

(56) References Cited

U.S. PATENT DOCUMENTS 4,227,874 A * 10/1980 Nugent ..... 432/261
7,211,293 B2 * 5/2007 Piana et al. ..... 427/240
2006/0199132 A1 * 9/2006 Scheibel et al. ..... 432/120

* cited by examiner

WORKPIECE-CARRIER

FIELD OF THE INVENTION

The present invention concerns an improved workpiece-carrier according to the preamble of independent claim 1.

Furthermore this application discloses an advantageous method of production and an advantageous use of the claimed workpiece-carrier.

Workpiece-carriers are used for thermal treatment of workpieces. Metallic workpiece-carriers, as they are known for example from DE 20 2006 008 712 U1 or DE 38 79 454 T2, are prone to plastic deformation at high temperatures. That is why such metallic workpiece-carriers used in high-temperature applications have to be replaced after a very short cycle of applications, because their plastically deformed shape is no longer able to provide the required, exact workpiece-support, that will allow thermal treatment of a workpiece without inducing thermal stress or deformation.

In contrast to metallic embodiments, this invention is situated in the area of carbon-fibre-reinforced carbon-composite-bodies.

A monolithic carbon-fibre-reinforced carbon-composite-body is known from DE 199 57 906 A1. Said composite-body is obtained by providing a preformed fibre-body having grid-shape, wherein said fibres are arranged in a grid-like shape of interconnected bars and have been soaked in a pyrolysable solution. Via carbonisation and/or graphitisation at high temperatures, the provided body is turned into a continuous carbon-composite-body. The body thus obtained is considered advantageous compared to bodies assembled from so-called 'CFC'-board-strip-gratings, because it is obtained at reduced cost by a single, concluding process-step. 'CFC' designates materials, which are based on Carbon-Fibre-reinforced-Carbon compounds; single board-strips have to be provided by machining said board-strips in a series of process-steps to the required dimensions.

The disadvantage of such monolithic gratings becomes apparent upon fracture of one of the grating's bars: It can not be replaced nor repaired. A single fracture will result in the complete grid being a total loss. Therefore, monolithic bodies are cheaper in production, but turn out to be much more expensive when applied in an area, where fracture-inducing impact, thrust, jolts or vibrations are common.

Workpiece carriers are used for example for heat-treatment, tempering or resintering of workpieces in vacuum, inert atmosphere or reactive atmosphere. During positioning of workpieces within a respective workpiece-carrier impact and/or vibration is commonly unavoidable. Deviating from the known monolithic bodies workpiece-carriers are therefore often provided by mutually engaging board-strips of carbon-fibre reinforced carbon composite material (CFC). The present invention concerns these workpiece-carriers consisting of mutually engaging 'CFC'-board-strips.

The required 'CFC'-board-strips are produced for example by arranging a carbon-fiber-composition or -fabric in required position of the later-obtained board-surface. By commonly known textile processes, woven fabrics or non-woven textile products can be shaped in forms like tubes, spheres, funnels or the like. The obtained carbon-fiber-composition or -fabric is then subjected to soaking of the fibers with a carbon-precursor-compound like resin, pitch or tar and subsequent, thermal conversion of said precursor-compound to carbon and/or graphite. Such carbon-fibre-reinforced carbon composite boards have carbon-fibers and/or -fabrics arranged continuously in parallel position to the board's surface, are stable up to 2000 degrees Celsius—even under load—, are of light weight and dimensionally stable. Therefore said boards are mechanically especially applicable as materials for workpiece-carriers, because the carried workpieces will suffer no deformation due to thermal expansion of such a 'CFC'-workpiece-carrier and in case of fracture or breakage of single, mutually engaging elements of a workpiece-carrier assembled from said single elements, said broken or fractured element can be separately exchanged, providing a cheap and continuous use at considerably reduced cost.

The frame of common, predescribed workpiece-carriers consists of CFC-board-strips with cut-out sections on one side, which engage mutually and form-fittingly upon insertion of the cut-out sections of a respectively arranged, comb-like element. Such a known combination of comb-like or comb-shaped elements provides a continuous structure, which will absorb and transduce an exerted load of force—i. e. weight—into all parts of the mutually engaging elements.

A plane grating is provided within said frame by said elements, said elements being likewise CFC-board-strips and being assembled via mutually engaging cut-out-sections, which match the cut-out-sections of the opposing, comb-shaped element. A force-load due to the weight of the workpiece is thus spread evenly by transduction into the grating; as predescribed said load is also distributed within the grating via intersectingly arranged elements. This results in an areal, even force-transduction along the whole construction.

A problem arises with such workpiece-carriers at high temperatures of 1100 degrees Celsius and more, as metal workpieces will react considerably with the carbon of the CFC-boards along the area of support/contact. The temperature range of 1100 degrees celsius to 2000 degrees celsius will be designated as high temperature or high temperature area, referring to the respective temperature within said area. Said reactions will produce locally carbides; in worst case carbon will diffuse into the workpiece at high temperature and the mechanical properties of the workpiece deteriorate drastically. Such will considerably degrade the quality of the workpiece, turning it into scrap in the worst case. Especially in the area of extremely tough alloys—as applied for example in the construction of turbines or engines—an extremely valuable as well as energy-affording workpiece is finally thus destroyed.

Workpiece-supports like spacers of inert ceramics, which are placed as supporting disks, vertically adjustable bases of pillars or completely assembled racks between a workpiece-carrier and the workpiece are known solutions to this problem. The term 'ceramic' relates to high temperature stable compounds, consisting mainly of at least one compound selected from the group consisting of oxides, carbides, nitrides and/or borides of at least one metal, 'inert' relating to the chemical compatibility with the respective workpiece-material especially at respective high temperature.

The known solutions are disadvantageous, because the supports have to be re-positioned for each workpiece before insertion—which can not be done with simple machines, especially in the case of complex workpieces—e. g. turbines. Complex workpiece-supports with a meticulous negative contour of the outer shape of the workpiece lead to a drastic increase of load of weight and a severe danger of deformation in case of mismatching surfaces during insertion. Thus such known workpiece-carriers result in rising costs of staff due to the required, manual corrections, slow down production and are additionally prone to workpieces slipping off their support in case of intense vibrations.

BACKGROUND OF THE INVENTION

In view of these problems WO2004/111562 proposes to avoid contact reactions by arranging strands of ceramic fibres as a grating within a temperature stable frame, said strands providing a screen of fabric-like structure, having a warp- and weftlike arrangement of strands within said frame. Such a strand-based grating turned out to have the draw-back, that ceramic strands will resinter considerably under high temperature conditions and become brittle; especially the intersecting fabric-structure in combination with brittle strands leads to breakage of strands in the support-areas of the workpiece, even if the supported workpiece is affected only by light vibrations.

JP 07 133 166 proposes to encase bodies of carbon-fibre-reinforced carbon composite material (CFC; abbreviated also as 'C/C' in English-spoken area of science) with a protective ceramic layer. Said layer, which covers the front of said material, is to be fastened via screw and nut, wherein the screw head is arranged in locking position on the ceramic layer, while the screw reaches across the ceramic layer and the subsequent layer of carbon-fibre-reinforced carbon composite material; a nut provides a tight, stable position of said screw, said nut being fastend on the rear surface of the carbon-fibre-reinforced carbon composite material. By positioning the ceramic layer on top of the carbon composite material the greater, thermal expansion of the ceramic material can not induce any tension or warping of the carbon composite body, while also avoiding any direct contact of a metal workpiece along the frontal surface. Furthermore, any tension or warping via the attached screw is avoided likewise, because screw and nut also have a greater thermal expansion than the carbon composite body.

A special disadvantage of this construction is however that upon reaching high temperature screw and nut—due to their greater thermal expansion—are no longer in tightly locked arrangement. The nut is no longer tightly attached to the rear side of the carbon composite body. Thus, said nut is loose at high temperatures. Furthermore, the loose arrangement of screw and nut will result in damaging impacts in case of vibrations: carbon composite body as well as ceramic layer will be prone to repeated, destructive impacts. Additionally, said nut is capable of free rotation at high temperature and may twist off the screw completely, resulting in complete failure of the fixation.

Likewise to the designations known from reinforced fibre composites, where a composite of two fibres of differing nature like metal/plastic are designated as 'hybrid fibre composite', such a grating combining a carbon composite body and fastened, ceramic spacers may be designated as 'hybrid grating'. The combination of the two materials provide a reliable, high temperature stable, grating, i. e. a high-temperature-grating 10.

Likewise to the predescribed JP 07 133 166 the document DE 103 12 802 proposes

- either to provide a monolithic, three dimensionally contoured workpiece-carrier with an additional groove obtained by milling
- or to obtain a horizontal, plane grating by assembling mutually engaging board-strips of carbon-fibre-reinforced carbon material, said board-strips having comb-like cut-out sections on one side, wherein a board-strip within the grating may have an additional cut-out-section or groove said groove/cut-out-section shaped to receive a ceramic workpiece-support. The additional cut-out section is arranged parallel the top-side of the grating and may removably receive a ceramic workpiece-support, said workpiece-support having an upper section to support the respective workpiece and a lower section to be inserted into the enclosing cut-out section. In order to secure a workpiece-support in a required position or at a required height, this document teaches to connect it to the respective board-strip via a screw and/or to assemble the ceramic workpiece-support of different, matching parts, which allow an adjustment of height.

In view of the predescribed disadvantages, securing a workpiece-support via an additional screw will also lead to the predescribed damages in case of vibrations. Likewise said screw will suffer the danger of turning loose and may damage the carbon composite body. Furthermore the weight of the dense ceramic will be transduced into all cross-wise oriented, comb-shaped elements, which means, that in case of impact or jarring impulse whole groups of elements will be subject to an improved, jarring, removing impulse, which may remove a complete group of elements from the grating. Especially in case of automatically handling the workpiece-carrier an impact, twist or flip will result in single, top-side comb-elements being completely removed from the grating due to the increased weight of attached, ceramic workpiece-support. Such a workpiece-carrier can only be handled safely, if it is enclosed completely along its whole bottom and kept in horizontal orientation without vibration. Otherwise, single elements may fall out of the grating. Any twist or turn of such a workpiece-carrier—especially a flip in an overhead-position—has to be avoided at all costs. The respective machines to provide such are finely adjustable and therefore very expensive.

A special disadvantage is that single workpiece-supports will be able to fall out of their enclosure in case of fracture or fissure. The free falling, ceramic shards will then induce further impacts and damaging forces in devices underneath the grating, e. g. they will damage workpieces, workpiece-carriers or conveyor-mechanics situated beneath said grating.

A special disadvantage is that ceramic workpiece-supports having grooves, notches or under-cuts are prone to cracking during cool-down if additionally subjected to the weight of a supported workpiece. They will have to be exchanged frequently, incurring further costs. Especially in the case of additional vibrations, impacts or jolts such workpiece-supports showed considerable wear and respective rise in costs, as these supports were prone to cracking along their grooves and/or under-cuts at least every second use, resulting in disintegration, separation and further damage in every third to fourth use.

A special disadvantage is that workpiece-supports according to the prior art will only provide additional support for a workpiece of irregular shape or raised center of gravity if arranged in a monolithic workpiece-carrier having a contoured shape, so as to provide workpiece-supports at differing height and position.

SUMMARY OF THE INVENTION

In view of the known prior art it is an object of the invention to provide an improved workpiece-carrier, which will avoid the disadvantages known from the prior art.

The solution to this object is obtained according to the independent device-claim.

Further advantageous embodiments provide further advantageous features and/or solutions to special disadvantages of prior art.

Further advantageous features can be found in the following specification, the further embodiments, examples as well as dependent claims.

The invention is not restricted to the combination of features of dependent claims, embodiments or examples. Within the scope of the independent claim single, additional, advantageous features may find application alone or in a combination differing from the combinations of the illustrative embodiments, without leaving the subject-matter of the present invention.

Summing up the present invention is directed at:

The inventive workpiece-carrier in the form of a high-temperature-grating 10 assembled from elements, said elements being carbon-fibre-reinforced carbon-composite-board-strips and said elements comprising comb-shaped elements, said workpiece-carrier having

- a frame, said frame being provided by mutually engaging frame-elements, and said frame-elements surrounding
- a horizontal grating 30, said grating 30 being provided by mutually engaging grating-elements which cross each other within the frame,
- as well as at least one workpiece-support 40 which is inert in relation to the supported workpiece and provides a workpiece-support-area 50 at a distance above the grating 30, said work-piece-support 40 being arranged within at least one enclosing cut-out-section of at least one element, characterised in that the elements comprise at least one element having interlocking cut-out-sections in alternating arrangement, the elements comprise at least one auxiliary element, said workpiece-support 40 is a single-piece part of high temperature ceramic of rod-shaped elongation, said elongation being arranged parallel to the plane of said grating 30, said workpiece-support 40 being an integral part of the grating by being enclosed beneath the workpiece-support-area 50 by cut-out-sections of a multitude of transversely arranged grating-elements while also being framed at its ends by transversely arranged continuous elements, the enclosed, non-removable workpiece-support being floatingly integrated within the grating, the workpiece-carrier being fastened in assembled position by the at least one auxiliary element, wherein each comb-shaped element has at least one auxiliary bore with an auxiliary element arranged tightly and form-fittingly in said auxiliary bore and each auxiliary element being furthermore arranged tightly and form-fittingly in at least one auxiliary bore of the at least one element having interlocking cut-out-sections in alternating arrangement.

An advantageous workpiece-carrier, characterised furthermore in that said workpiece-carrier has a rectangular frame and centrosymmetrically arranged workpiece-supports within said frame.

An advantageous workpiece-carrier, characterised furthermore in that all elements within the horizontal grating of the workpiece-carrier are arranged in vertical orientation, providing a grating of crossing edges within the frame.

An advantageous workpiece-carrier, characterised furthermore in that at least one auxiliary element is at least as long as one horizontal diameter of the workpiece-carrier and is arranged across said diameter tightly and form-fittingly in the auxiliary bores.

An advantageous workpiece-carrier, characterised furthermore in that at least two auxiliary elements are at least as long as the horizontal width of the workpiece-carrier and are arranged across said width tightly and form-fittingly in the auxiliary bores, securing each comb-shaped element via two auxiliary bores arranged symmetrically at opposing ends of said comb-shaped elements.

An advantageous workpiece-carrier, characterised furthermore in that at least one element, preferably an element of the frame, has in a downside-area relative to the grating a cut-out engagement-section in essentially parallel orientation to the plane of said grating.

An advantageous workpiece-carrier, characterised furthermore in that vertically positioned, mutually engaging elements are integrated at least into the grating, wherein said elements provide at least one vertically positioned frame, preferably at least one vertically positioned frame with a vertically positioned grating arranged within, especially preferred with additionally integrally fixed, floatingly mounted single-piece high temperature ceramic workpiece-supports in vertical orientation providing prop-up-elements.

An advantageous workpiece-carrier, characterised furthermore in that at least one interlocking grating-element having a vertically arranged, mutually engaging down-side cut-out-section has at least two neighbouring upside cut-out sections, wherein each upside cut-out section is arranged in mutual engagement with a form- and force-fittingly, transversely oriented element having a respective down-side cut-out section.

An advantageous workpiece-carrier, characterised furthermore in that the dimensions of at least one workpiece-support-enclosing cut-out section of crosswise oriented elements is equal to the thermally expanded dimensions of the enclosed workpiece-support under high-temperature conditions.

An advantageous workpiece-carrier, characterised furthermore in that at least one workpiece-support has a trapezoidal cross-cut, wherein the base of said trapezoid is positioned parallel to the plane of the grating with continuous contact to the plurality of elements.

An advantageous workpiece-carrier, characterised furthermore in that at least one workpiece-support is arranged so as to provide in a cross-cut-view an upper surface parallel to the horizontal plane of the grating, providing a workpiece-support-area in plane-parallel orientation to the plane of the grating.

An advantageous workpiece-carrier, characterised furthermore in that at least one workpiece-support consists of a ceramic-based compound, wherein furthermore the workpiece-support-area consists of one single compound.

An advantageous workpiece-carrier, characterised furthermore in that at least one workpiece-support is a resintered ceramic obtained from a formed, machined, green ceramic compact, said workpiece-support having a contoured workpiece-support-area.

An advantageous workpiece-carrier, characterised furthermore in that at least one workpiece-support consists of a material selected from a group consisting of alumina, mullite and partially stabilised zirconia.

An advantageous workpiece-carrier, characterised furthermore in that at least on group of workpiece-supports, preferably all workpiece supports, have equal length, preferably having a length in the range of 0.01 to 1 meter, more preferably 0.05 to 0.8 meter, most preferably 0.08 to 0.6 meter, preferably in combination with a thickness of 0.2 to 25 centimeters, preferably 0.5 to 15 centimeters, most preferably 1 to 8 centimeters. Preferably, said workpiece-supports of equal length have a maximum aspect ratio of length/diameter of 1000/1, more preferably 100/1, most preferably 50/1.

An advantageous workpiece-carrier, characterised furthermore in that at least one workpiece-support has a central, continuous, longitudinal bore in parallel position to the workpiece-support-area, wherein an additional element of the workpiece-carrier is arranged in a fixing position.

An advantageous workpiece-carrier, characterised furthermore in that said workpiece-carrier has as a plurality of workpiece-supports which are inert in relation to the supported workpiece and provide a workpiece-support-area providing an upside-distance to the grating wherein furthermore
the longitudinally elongated workpiece-supports 40
are an integral, floatingly mounted part of the grating and
- provide a plane-parallel workpiece-support-area 50
- consist of single-piece, sintered alumina
- are rod-shaped and of equal length
- have a trapezoidal cross-cut 41 with symmetrical side-sections and rounded edges
- have a central, continuous, longitudinal bore 42, wherein an element is arranged in a fixing-position
- are centrosymmetrically arranged in close-to-frame positions
- are arranged
  - crosswise to a multitude of parallel elements 60, said elements having vertical edges, which mutually enclose the workpiece-supports 40 below the workpiece-support-area 50
  - with continuous contact to the group of parallel elements 60 along their bottom-surface
  - at a distance to the adjacent, crosswise oriented, framing elements and wherein the elements having an enclosing, vertical edge 60
- each have at least two up-side cut-out-sections 61, neighbouring the longitudinally elongated, enclosed workpiece-supports having close-to-frame positions 40
- each of the neighbouring up-side cut-out section 61 having a form-fitting and force-fitting, mutually engaging, transversely positioned element 62
- each element (62) having respective down-side cut-out sections wherein preferably furthermore vertically positioned elements 70, providing a vertical frame, are integrated at least via a trapezoidal base 71 and in each case, with at least two down-side cut-out sections and an auxiliary bore, at least into the grating.

An advantageous workpiece-carrier, characterised furthermore by being obtained by a method which provides CFC-fiber-board-strips from CFC-boards having
- at least one fabric consisting of carbon fiber-rovings
  - having linen weave
  - having a thickness of fiber of 3 to 10 micrometers and
  - providing a fabric-area having square delimitation of up-weave and down-weave of the rovings arranged at essentially right angles to each other
- dry-machined edges parallel to the direction of warp-rovings—preferably dry-machined with machining-tools coated with a polycrystalline diamond layer—with an accuracy of 20 micrometers, providing CFC-board-strips,
- said CFC-board-strips having dry-machined cut-out sections—preferably provided by using milling tools coated with a polycrystalline diamond layer under dry conditions—with an accuracy of 20 micrometers,
  - wherein said cut-out sections have a depth relative to the size of square
  - provided by the fabric of at least (depth:length of square-side)=1.4:1 the CFC-board-strips having cut-out sections—preferably provided in groups with enclosing dry-machined cut-out sections—matching single-piece workpiece-supports consisting of high temperature ceramic—preferably provided by using using tools coated with a polycrystalline diamond layer under dry conditions.

Subsequently in said advantageous production all machined/cut/milled surfaces are blown clear pneumatically with air and the high temperature hybrid grating is assembled via inserting the provided elements into each other, inserting the workpiece-supports, inserting framing elements, -inserting if needed further elements and/or workpiece-supports along with framing elements—inserting finally comb-shaped elements and concludingly fastening the workpiece-carrier in assembled position by inserting at least one additional auxiliary element along a series of auxiliary bores situated within the structure of the workpiece-carrier.

An advantageous workpiece-carrier, characterised furthermore in that said workpiece-carrier is provided with each pair of matching cut-out sections being arranged in a fabric-area with a maximum number of orthogonally oriented fibers.

An advantageous workpiece-carrier, characterised furthermore in that said workpiece-carrier is provided with elements to be arranged in parallel on top of each other, said elements having locally matching structure of fabric and linking cut-out sections and protrusions of likewise accuracy.

An advantageous workpiece-carrier, characterised furthermore in that the high temperature grating, having plane-parallel frame-surface and grating-surface, is provided as mountable part of a wall within a high-temperature chamber, being applicable as permanently installed, non-warping, inert prop-up surface.

BRIEF DESCRIPTION OF FIGURES

The figures illustrate

Figure 1:
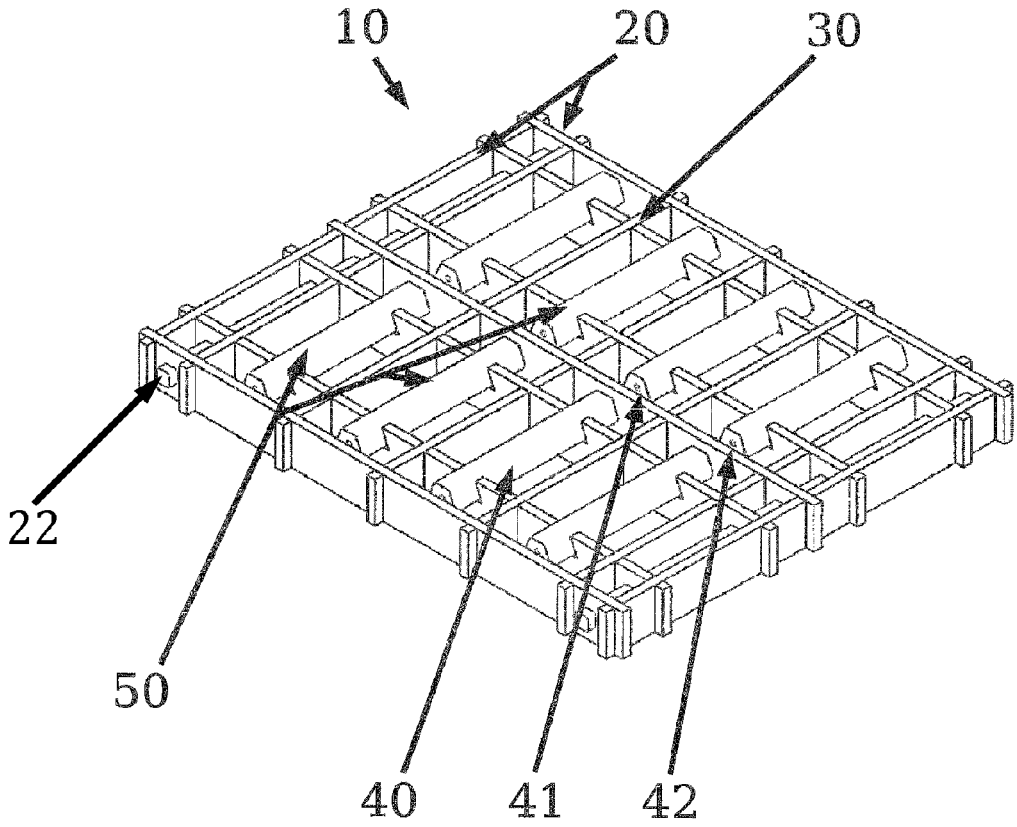
FIG. 1 an advantageous high temperature hybrid grating (10) with longitudinally elongated workpiece-supports in close-to-frame positions FIG. 2 an enlarged, partial view of a high temperature hybrid grating according to FIG. 1

The references within said figures referring to:

10 high-temperature grating
20 rectangular frame
21 comb-shaped element
22 auxiliary element
30 grating
40 workpiece-support
41 trapezoidal cross-cut
42 central, continuous, longitudinal bore
50 workpiece-support-area
60 elements having an enclosing, vertical edge
61 up-side cut-out-section
62 transversely positioned, mutually engaging element
63 down-side cut-out-section
65 grating-element having interlocking cut-out-sections
66 enclosing cut-out-section
67 auxiliary bore
70 vertically positioned element
71 trapezoidal base of element

DETAILED DESCRIPTION OF THE INVENTION, OF ADVANTAGEOUS FEATURES AND PREFERRED EMBODIMENTS

According to the invention the claimed, improved workpiece-carrier is constructed in the form of a high-temperature-grating 10. The grating 10 consists of the predescribed CFC-board-strips, i. e. carbon-fibre reinforced carbon composite board strips. A workpiece-support 40 made of a high temperature ceramic has been integrated tightly into the grating during assembly. The workpiece-support is integrated as part within the grating, however without transducing tensile assembly-forces of the grating into said workpiece-support. Instead said workpiece-support is a single-piece and its upper part protrudes the plane of the grating upwardly. 'Single-piece' designates a completely sintered, continuous body, that may be shaped or contoured, but preferably has no recesses, ridges, protruding edges at right angles or undercuts. The workpiece-support is therefore a single, solid, continuous piece of high temperature ceramic, that preferably shows a continuous, outer surface without sharply defined, angled ridges or grooves, avoiding advantageously premature breakage or early cracking reliably. Said protruding part provides a workpiece-support-area, while the lower part is fixed within the grating by a multitude of enclosing CFC-board-strips. Said construction provides a fixation of the workpiece-support by a plurality of CFC-board-strips enclosing the workpiece-support form-fittingly in the lower part. 'Enclosing' relates to an arrangement, wherein CFC board-strips reach over the lower part of the workpiece-support at least partially and in a form-fitting way, while the grating is of continuous structure at the bottom of the workpiece-support, resulting in a workpiece-support that may at maximum be shifted slightly in its position, thus becoming an integral component of the grating. The workpiece-support can not be removed without prior disassembly of the grating. The ceramic, single-piece workpiece-support fixed within the grating provides a workpiece-support-area, which is stable under load, can not slip away sideways, will not become brittle and avoids the drawbacks of known workpiece-carries, even if the workpiece-carrier is handled mechanically, including mechanically actuated rotation, flips and jarring vibrations.

The inventive workpiece-carrier comprises comb-shaped elements. Throughout this application, the term 'elements' designates CFC-board-strips. 'Comb-shaped elements' are CFC-board strips, which have cut-out sections on one side only and resemble a comb with more or less broad teeth. Via equally sized cut-out-sections, which match the thickness of an opposite element with a likewise cut-out-section, such elements can be inserted into each other in a mutually engaging manner as known from prior art.

The inventive workpiece-carrier 10 has a frame, which is assembled from elements. Said elements provide a frame in mutually engaging arrangement, are CFC-board-strips and are assembled via their cut-out-sections in mutually engaging manner. The frame-elements thus surround a planar area, wherein a grating 30 is arranged.

The inventive workpiece-carrier has a horizontal grating 30, which is provided by grating-elements, which are arranged within the predescribed frame. The grating-elements cross each other within the frame and are connected to the workpiece-carrier in mutually engaging manner via their cut-out-sections.

As the plane of the grating 30 is introduced as 'horizontal', an 'upside' or 'upward' direction refers to the top of said grating, where a workpiece is inserted. Such defines in the following all 'upside surfaces' of further objects likewise, e. g. a workpiece will be resting with its down-side bottom on the workpiece-carrier, while its upside surface is facing away from the grating. Consistent with these orientations 'vertical' arrangements are those, that extend at essentially right angle to the horizontal plane of the grating 30.

The inventive workpiece-carrier has at least one element having interlocking cut-out-sections in alternating arrangement. Differing from the known elements with comb-shaped arrangement, this element has cut-out-sections in alternating arrangement, i. e. on opposite sides. In assembled state within the inventive workpiece-carrier such an element is integrated from two sides within the structure of the workpiece-carrier. It can not be removed along one direction from the structure without interference of one of the mutually engaged, further elements on one of the opposing sides. Thus, the arrangement of cut-out-sections on opposing sides of the element hold said element within the structure of the workpiece-carrier. Such an element is therefore an 'interlocking' element. In view of the provided properties, the cut-out-sections are designated as 'interlocking cut-out-sections in alternating arrangement'.

The inventive workpiece-carrier comprises at least one auxiliary element. An auxiliary element is lengthwise elongated, consists in accordance with its designation of a machined CFC-board-strip and is arranged crosswise to the structure i. e. elements of the assembled workpiece-carrier. Deviating from the mutually engaging cut-out-sections, the auxiliary element is arranged form-fittingly and force-fittingly in auxiliary bores of the crossed elements. Form-fittingly designating a closely matching contour of auxiliary element and auxiliary bore, which will come into full contact in assembled position; thus in assembled position, the auxiliary element will transduce directly all forces exerted onto a crossed element having the auxiliary bore with auxiliary element arranged therein.

Force-fittingly designates therefore the matching, force-transducing contour of auxiliary element and auxiliary bore: The auxiliary element punctures in assembled position all crossed elements via auxiliary bores. The tight, fitting arrangement of auxiliary element and auxiliary bore is also force-transducing, which is designated as force-fittingly, because force-transduction is provided by said closely matching geometry. As all elements consist of the same type of material, i. e. CFC-board-strips, said force-transduction will be continuously effective at any temperature.

The inventive workpiece-carrier has a workpiece-support which has a longitudinally elongated, rod-like shape, extending along the plane of the horizontal grating. The workpiece-support is positioned crosswise to a multitude of elements having likewise orientation within the grating. Thus, the multitude of elements of likewise orientation among each other is in transverse, horizontal position in relation to the elongation of the rod-shaped workpiece-support. The longitudinally elongated shape ensures the workpiece-support to be enclosed by a whole multitude of elements, each element having a respective, enclosing cut-out-section; the workpiece-support is furthermore framed at its ends by continuous elements with small clearance. Said continuous elements have no cut-out-section and frame the workpiece-support crosswise. Thus, said workpiece-support is enclosed crosswise beneath the workpiece-support-area within cut-out-sections of a multitude of elements and can not be removed by sliding it along its direction of elongation; the continuous element at each end of the workpiece-support render said workpiece-support an integral, non-removable part of the grating. The small clearance between each end of the workpiece-support and the respective, continuous element will ensure the feature of a floating mounting of the workpiece-support, which will transduce lateral impulse in the direction of elongation not directly, but dampen said impulse because of said clearance. The element is not clamped tight in the grating. It may be moved slightly within its fixation. Especially in a flow-through furnace with areas of differing duration of treatment, where workpiece-supports are moved along in one direction and orientation intermittently via transport-systems, the dampening of horizontal impulse is important. Furthermore, the floating fixation of said workpiece-supports allows a direct and easy examination of workpiece-supports: After heat-treatment and removal of a workpiece, said elements can be checked for fissures, cracks or damages directly by sliding them to and fro within their floating mount.

Advantageously the workpiece-supports are examined acoustically by subjecting them to a ringing, short impulse of low force onto the upside protruding workpiece-support area and detecting and analysing the resulting sound. Most advantageously, the workpiece-supports are all of equal length and arranged in predefined, symmetrical positions, which allows an automatic examination once the workpiece-carrier has been arranged in a predefined orientation; thus workpiece-supports can be checked for fissures, cracks and damages within an automated procedure at rapid speed with high accuracy while reducing cost of staff and improving quality of treatment.

The inventive workpiece-carrier is fastened in assembled position by the at least one auxiliary element, wherein each comb-shaped element has at least one auxiliary bore with an auxiliary element arranged tightly and form-fittingly in said auxiliary bore and each auxiliary element being furthermore arranged tightly and form-fittingly in at least one auxiliary bore of the at least one element having interlocking cut-out-sections in alternating arrangement. Thus, all comb-shaped-elements are connected to at least one interlocking element, turning the assembled workpiece-carrier into a single, continuous body, that has no removable elements. Alle elements are fastened within the workpiece-carrier and can not be removed prior to removal of the auxiliary elements, while the workpiece-supports are floatingly fixed in their positions within the grating via enclosing and framing elements. Thus the inventive, claimed workpiece-carrier is the first to provide a continuous, force-transducing assembly of elements, i. e. CFC-board-strips, with floatingly mounted, ceramic workpiece-supports, that will stay in assembled position even if subjected to jarring vibrations, rotations or flips making even automatic handling with intermittent arrangement in an overhead-position possible.

Advantageously a workpiece-carrier has a rectangular frame and centrosymmetrically arranged workpiece-supports within said frame. A rectangular frame having a long and a broad side will ensure two different sides and orientations, which can be distinguished even by simple, automatic controls. Centrosymmetrically arranged workpiece-supports will always be in the same positions, once a lengthwise ore transverse orientation of the workpiece-carrier is given; the positions of the workpiece-supports will not depend on the number of rotations or flips, once one of the predescribed orientations has been reached. Especially preferably workpieces are inserted mechanically into likewise mechanically oriented workpiece-carriers of such a design, as any mismatch of workpiece-support position and workpiece-position is no longer possible.

Advantageously a workpiece-carrier has all elements within the horizontal grating of the workpiece-carrier arranged in vertical orientation, providing a grating of crossing edges within the frame. Such a grating provides a horizontal surface of force-absorbing structure, which transduces forces more evenly at higher stability. Additionally such a grating allows air, gas, oil or reactive atmosphere to pass through the grating in vertical direction without significant resistance, which improves the efficiency of treatments of supported workpieces with reactive media. Reactive media pass through such a grating of crossing edges in vertical direction. The Workpiece, which is supported at a distance above the grating, will be affected by the reactive media along its whole surface, improving the treatment and shortening the required treatment-time to an advantageous minimum.

Advantageously a workpiece-carrier has at least one auxiliary element, which is at least as long as one horizontal diameter of the workpiece-carrier. Thus said auxiliary element will extend across the complete structure of the workpiece-carrier. Due to the tightly and form-fittingly arrangement of the auxiliary element in auxiliary bores the complete structure of a workpiece-carrier will be interconnected along the plane of insertion of this auxiliary element. Thus, one element will provide a transduction of forces at maximum efficiency, simplifying the necessary sequence of steps of assembly and shortening the required time of assembly or disassembly during service and repair.

Advantageously a workpiece-carrier has at least two auxiliary elements at least as long as the horizontal width of a workpiece-carrier and are arranged across said width tightly and form-fittingly in the auxiliary bores, securing each comb-shaped element via two auxiliary bores arranged symmetrically at opposing ends of said comb-shaped elements. Auxiliary bores arranged at symmetrical positions prevent an error in orientation of an element: Once one of the auxiliary bores is in correct orientation, the same will apply to its symmetrically arranged counterparts within the same element. Preferably the symmetrical arrangement of auxiliary bores goes along with a likewise symmetrically arranged arrangement of cut-out-sections, most preferably symmetrically arranging also the fabric structure of the CFC-board strip in relation to cutout-sections and auxiliary bores. The symmetrically arranged auxiliary bores simplify assembly, preventing errors due to faulty orientation, while the auxiliary elements transduce forces along the complete width, 'width' designating the horizontal distance between two opposing sides of the workpiece-carrier. As comb-shaped elements have likewise auxiliary bores, the symmetry of arrangement extends even to the secured, comb-shaped elements, preferably even to the interlocking element and its cut-out-sections in alternating positions, resulting in a highly symmetrical arrangement, wherein comb-shaped elements are locked within the structure of the workpiece-carrier via two auxiliary bores; especially in the case of workpiece-carriers of great length and small broadth, comb-shaped elements extending along the length will be locked advantageously by two elements at improved efficiency, preventing even slightest looseness of mutually engaging cut-out sections within the workpiece-carrier due to elastic deformation along said length.

Advantageously at least one element, preferably an element of the frame, has in a downside-area relative to the grating a cut-out engagement-section in essentially parallel orientation. Such an engagement-section is positioned below the plane of the grating and allows a form-fitting engagement on the bottom side and provides the possibility to fasten a workpiece-carrier, which is placed on a floor space, in place. Thus workpiece-carriers placed on conveyors, said conveyors moving up steep slopes, will be secured against slide-off by bottom-side engagement means. Furthermore automatic handling of workpiece-carries will be easier and safer, because any top-side damage of grating or carrier is advantageously no longer possible. Furthermore such an engagement-section allows the versatile fastening of such a workpiece-carrier in racks, vertical gratings and shelves. Especially advantageous is a plurality of these cut-out sections for engagement of likewise orientation, which will provide additional, even stabilisation against lateral shift; especially advantageous frame-structures with such engagement-means are combinable, i. e. the frame-structures are interconnectable, providing a highly versatile system of adaptable frame-structures.

Advantageously vertically positioned, mutually engaging elements are integrated at least into the grating, wherein said elements provide at least one vertically positioned frame. Such a vertical frame bridges the grating of a horizontally oriented workpiece-carrier, protects structurally a workpiece carried within the workpiece-carrier and additionally offers the advantage of form-fittingly fastening the workpiece-carrier within a matching rack along the topside of the workpiece-carrier. Thus such a workpiece-carrier allows the advantageous, modular, automatic handling of workpiece-carriers in whole groups, wherein the workpieces are additionally confined and spaced apart by the bridging vertical frames.

Preferably at least one vertically positioned frame has a vertical grating arranged within; a vertical grating consists—alike to the workpiece-carrier's grating—of intersectingly oriented elements and divides the workpiece-carrier into at least two volumes. Such allows—especially in the case of small workpieces—a concerted carrying and treating of a plurality of workpieces in one workpiece-carrier while ensuring confined volumes for each workpiece. Especially preferred a vertical frame has additionally integrally positioned single-piece high temperature ceramic prop-up-elements. Such provides—alike to the predescribed, advantageous ceramic workpiece-supports—a workpiece-carrier having ceramic workpiece-supports and prop-up-elements, in which a workpiece is advantageously protected against carburisation along all downside and lateral points of contact, even if the workpiece is prone to considerable twist or slide within the workpiece-carrier, as no contact with any CFC-board-strip is possible.

Advantageously elements with a vertically arranged, enclosing edge within a cut-out-section, have each at least two neighbouring upside cut-out sections, wherein each upside cut-out section is arranged in mutually engaging position with a form- and force-fittingly, transversely oriented element having a respective down-side cut-out section. The flow of forces is thus controlled as described in the following: A load of force exerted by the workpiece is transduced via the workpiece-supports and the continuous grating below said workpiece-supports into the structure of the workpiece-carrier. A vertically oriented, enclosing element is pushed downward to extend convexly below the plane of the grating. The neighbouring, upside cut-out-sections are compressed by this deformation. The form- and force-fitting, transverse elements, which have been inserted mutually engaging in said cut-out sections, are subject to the predescribed compression and the retention force of the mutually engaging joint is increased; thus the induced force is dissipated from enclosing longitudinally positioned elements directly into transversely positioned elements. A force of weight induced via workpiece-supports and longitudinal elements of the grating is thus dissipated into transverse elements, evenly distributed and will be compensated within the grating at improved efficiency. Such advantageous construction provides much more stable and much more lightweight workpiece-carriers, which ensure a stable position of a workpiece on its workpiece-supports.

Most advantageously such a workpiece-carrier is equipped with two neighbouring, upside cut-out-sections in enclosing elements for each and every workpiece-support in directly neighbouring position with mutually engaging inserted, transversely oriented elements with form- and force-fittingly down-side cut-out sections; two directly neighbouring cut-out sections provide the shortest possible way of force-transduction into the grating, resulting in an advantageous stability of the workpiece-carrier and a minimum, elastic movement of workpiece-support-area.

Advantageously a workpiece-carrier has dimensions of at least one workpiece-support-enclosing cut-out section of crosswise oriented elements equal to the thermally expanded dimensions of the enclosed workpiece-support under high-temperature conditions. While the predescribed enclosures of workpiece-supports are larger in dimension, in order to ensure a floating mount even at high temperatures, a special embodiment may be provided in case the exact temperature of treatment is known: For such a case, the dimension of an enclosing cut-out section ca be reduced to almost the same size, which results in a force-fitting enclosure of the workpiece-support upon reaching the specific high temperature. Such advantageously allows treatments, wherein the workpiece must not move or vibrate at all when reaching the peak temperature. In case of such treatments, special devices and measures ensure, that no vibration or impulse will reach the workpiece-carrier. By reducing one cut-out section in its size as predescribed, all workpiece-supports will be locked in position upon reaching peak temperature, further improving the stability of the supported workpiece and reducing the risk of shift or movement.

Advantageously the workpiece-support has a trapezoidal cross-cut, wherein the base of said trapezoid is positioned parallel to the plane of the grating with continuous contact to the plurality of elements. The continuous contact of said base will transduce a weight-load of a workpiece right at the workpiece-support more evenly into a larger area, providing a more distributed transduction of force into the adjacent grating underneath; furthermore a trapezoidal cross-cut allows a stable fixation along the respective surface of the sides of said trapezoid by crosswise enclosing elements of the grating.

Advantageously at least one workpiece-support is arranged so as to provide in a cross-cut view an upper surface parallel to the plane of the grating, providing a workpiece-support-area in plane-parallel orientation to the plane of the grating; plane-parallel, even support-areas avoid the danger of scratching or damaging the surface of the workpiece in case of lateral impulse. Preferably in the case of workpieces having an even support-area like an even base of a pedestal, workpiece-carriers with several, plane-parallel support-areas will be applied, making any slide-off impossible; especially preferable in such a case are workpiece-carriers, which have in combination workpiece-supports along the frame-area, which have protruding bumpers, thus even avoiding slight point-contacts of workpiece and frame.

Advantageously at least one workpiece-support consists of a ceramic-based compound, wherein furthermore the workpiece-support-area consists of one single compound. A workpiece-support consisting of a ceramic-based compound with further particles has a better stability in relation to formation of cracks or fissures, while a workpiece-support-area consisting of a single, ceramic compound will provide a constant temperature of contact of the workpiece on the workpiece-support. Thus thermally homogeneous workpiece-support-areas are provided and at the same time an irregular load of force onto the workpiece-supports—especially in the case of mismatching displacement—is better compensated in relation to formation of cracks or fissures. Especially when treating asymmetrical workpieces with unbalanced load of weight-force in a reactive gas-atmosphere a homogeneous temperature of contact will ensure homogeneous reaction along the workpiece-support-area, while the workpiece-supports provide improved, mechanical stability.

Advantageously at least one workpiece-support has been obtained by resintering a formed green ceramic compact, said workpiece-support having a contoured workpiece-support-area. So-called 'green' ceramic compacts consist of a ceramic raw material of extremely small grain and a binder, said binder being removable by heat, i. e. sintering the raw material at high temperature; such 'green' ceramic compacts may be machined as needed—i. e. by milling and drilling. By subsequent sintering the binder will be removed while the compact will be turned into a solid ceramic with exactly predictable shrinkage, keeping the initially contoured, complex shape. Such can advantageously provide a complex contoured workpiece-support in an inventive workpiece-carrier. An additional advantage will be obtained by contoured workpiece-support-areas. 'Contoured' denoting an outer shape characterised by at least two slopes at opposite angles; such a workpiece-support will receive a workpiece and allow said workpiece to slide all by itself into the desired resting position along said slopes, self-adjusting its position within the workpiece-carrier. Especially advantageously a plurality of said slopes are provided in combination, improving the stability of the desired position and supporting the workpiece in more than one area, which will protect the workpiece especially from thermal warping along said support-positions.

Advantageously at least one workpiece-support consists of alumina. Alumina will provide an extremely durable and inert support-surface up to temperatures of 1900 degrees celsius, which can be contacted with many and varying workpiece-materials, without incurring the danger of detrimental reactions. Preferably such a workpiece-support consists of 99.9% pure, resintered, polycrystalline fused corundum, providing an optimum combination of low price and chemical stability.

Advantageously at least one workpiece-support consists of mullite. Mullite provides up to 1800 degrees celsius an excelling resistance to thermal shock, allowing annealing- and sintering-methods, which require extreme changes in temperature. Mullite workpiece-supports will sustain such treatments without incurring the danger of fracture or fissure along the surface of the workpiece-support. Especially preferably such a workpiece-support consists of openly porous mullite having gas permeability; thermal shock resistance of such a mullite is best, while the gas-permeable workpiece-support area advantageously allows treatments in reactive gas atmosphere, where even along the supported surfaces a reaction with the reactive gas is ensured.

Advantageously at least one workpiece-support consists of partially stabilised zirconia. Partially stabilised zirconia is extremely durable at any temperature within the high temperature range, mechanically stable and chemically inert; by internal transition of its crystaline structures it is capable of compensating extreme, mechanical loads without fracture.

Advantageously at least one workpiece-support has a central, continuous, longitudinal bore in parallel position to the workpiece-support-area, wherein an additional element of the workpiece-carrier is arranged in a fixing position. Especially while automatically handling a workpiece-carrier, an impulse-like, focused impact onto the ceramic workpiece-support may result in a vertical fracture. The additional, fixing element keeps the fragments in place, stabilising the workpiece-support at least until the treatment of the workpiece is finished. Thus a sudden break-away of one of the workpiece-support-areas is prevented, the amount of waste is minimised and the number of necessary verifications during treatment is lowered.

While examining prototypes of the claimed construction, the inventors found all practical needs of usual use to be fulfilled dependably. Vibrations turned out to be of special importance, as they would affect the dense, heavy, integrally mounted, sintered ceramics, inducing mechanical impulse, which was amplified by the heavy ceramics and transduced into the CFC-board-strips at amplified strength. A series of tests was conducted with cut-out sections polished to an accuracy of +−5 micrometers, resulting in a non-satisfactory stability in relation to continued vibrations in spite of the highly accurate, mutually engaging cut-out sections; likewise clamped joints, which were force-fittingly assembled by twisting slopes of wedge-like, corresponding contours of elements with controlled fastening-force, turned out to be almost as bad.

Some of the examined prototypes showed a considerably superior stability against vibrations; said prototypes would tolerate vibrations of high energy and high frequencies for minutes without showing any slackening or loosening of mutually engaging connections nor assembly.

The inventors assume the improved vibration-stability to be due to a combination of accuracy and method of production of the cut-out sections and the orientation of carbon fibers within said cut-out sections. The respective combination of features and measures described in the following provides for the first time a hybrid grating of excelling stability against vibrations:

Advantageously a high temperature hybrid grating is produced according to a method described in the following, providing the respective constructional features:

The starting material are CFC-boards, which have at least one layer of fabric of carbon fiber rovings in a linen weave structure.

'Rovings' are groups of continuous, non-twisted fibers, which are contained within the CFC-board—prior to carbonizing/graphitizing of the board—in at least one linen weave fabric structure.

'Linen weave' is characterised by tight, intersecting arrangement, having two groups of parallel strands oriented at right angle to each other, wherein each strand alternatingly passes below and above the subsequent strands of the other group. Such a weave is of similar structure along both sides of the fabric and has an equal number of lifts and downs of warp and weft. A CFC-board produced with such a layer on top will display a chessboard-like structured surface, displaying the evenly spread rovings, which are arranged at right angles to each other. 'Warp' designates in such a CFC-board one of the two groups of strands arranged at right angles, 'weft' being the respective other group. Thus such a CFC-board has a fabric-surface having a square delimitation of lifts and downs of warp of the groups of rovings arranged at right angles.

The thickness of fibers contained within the single rovings is in the range of 3 to 10 micrometers.

Such CFC-boards are then dry-cut to CFC-board-strips at an accuracy of +−20 micrometers, using PCD-tools, to provide the CFC-board-strips of the high temperature hybrid grating. 'PCD' designating polycrystaline diamond-coated tools, i. e. cutting—as well as milling-tools, which have on their milling or cutting surface a layer of polycrystaline diamond.

The inventors assume this combination of dry, abrasive machining and accuracy results in a plurality of carbon fibers being exposed along the cut or milled surface, wherein the tool will bend said fibers without breaking them, the fibers thus finally extending brush-like above the cut or milled edge. Such a plurality of brush-like extending fibers is able to explain consistently the superior stability against vibrations as will be shown in detail; cut-out sections produced by cutting via water-jet-cutting or at higher accuracy failed to show the superior stability against vibrations, which the inventors consistently attribute to the higher accuracy or high-power water jet, which will break off the fibers evenly along the cutting/machining surface upon first contact.

Edges which were completely parallel in orientation to an adjacent CFC-fiberstrand showed no improved stability against vibrations, which confirms the consistency of the explanation of the inventors: If a cut or a milled edge was situated within a single roving, which was in parallel orientation, said roving failed to provide any extending fibers at right angle, thus not being able to produce an area with a group of brush-like extending fibers.

In order to reliably provide the increased stability against vibrations, an edge had to have a ratio of edge-length to length of square side of a square lift or down of a roving, i. e. (cutting depth:length of square side) of at least (1.4:1). The inventors assume the extending brush-like fibers to bend flexibly during insertion of CFC-board-strips into each other; in the final, mutually engaging position the broken ends of the fibers get stuck on the surface of the mutually engaging CFC-board-strip, inducing an elastic tension into the mutually engaging fixation and resting firmly on the inserted surface. In case of vibrations such fibers will elastically dampen the induced impulse and improve in surprising efficiency the stability against vibration along the matching, mutually engaging cut-out sections.

Consistent with this explanation CFC-board-strips, having cut-out-sections, that were finally polished to higher accuracy or wet-cut and dried at high temperature, showed no improvement in stability against vibrations; such can be attributed to the fibers being polished off or becoming brittle during drying. Likewise a deliberate, repeated, forced inserting and removing of two mutually engaging board-strips at slight mismatch, producing visibly abraded particles, decreased the stability against vibrations of such a high temperature hybrid grating. In view of these results any abrasive wear like polishing or cleaning the cut edges, ought to be avoided, in order to ensure the improved stability against vibrations.

As long as the cut-out-sections are cleaned by blowing them clear pneumatically, i. e. with air, and assembling the board-strips without abrasion—which will always be the case if average care is applied—the improved stability against vibrations could always be obtained in combination with the predescribed measures.

Advantageously and consistently with the explanation given by the inventors a maximum increase of stability against vibrations was observed, when each pair of matching cut-out sections is arranged in a fabric-area with a maximum number of orthogonally oriented fibers.

Advantageously the predescribed method is applied to gratings with elements to be arranged in parallel on top of each other by providing these with locally matching structure of fabric and linking cut-out sections and protrusions of likewise accuracy; the matching fabric guarantees two mutual, brush-like, structured, opposing edges, where the fibers will lock onto the opposite surface and additionally into each other, improving significantly the stability vs. vibrations.

Furthermore an advantageous use of the inventive device is claimed, which is contradictive to the nature of a separately mobile workpiece-carrier: Instead of carrying a workpiece, the high temperature hybrid grating, having plane-parallel frame-surface and grating-surface, is applied as part of a wall within a high-temperature chamber, as permanently installed, non-warping, inert prop-up surface. Workpieces will then be propped up against the prop-up-surfaces, which are provided by the predescribed workpiece-supports. Especially in the case of individually contoured workpieces and small-scale series the use of a workpiece-carrier as permanent part of a treatment-chamber will decrease the amount of weight to be handled manually; furthermore arrangement of varyingly contoured workpieces within said chamber becomes much more simple, saving time and increasing efficiency.

In the following preferred embodiments—exemplified in more detail by the schematic sketches of the figures—will be described in detail. Specific means will be identified additionally by reference-numbers and their function is explained.

An advantageous embodiment, illustrated schematically in FIG. 1, has a high temperature hybrid grating 10, assembled from vertically interlocking elements, wherein intersecting elements are arranged at right angles. The vertical arrangement throughout all elements results in a grating of high carrying capacity and minimal, areal coverage, which is especially applicable in multi-storey arrangements, in which a plurality of workpiece-carriers is to be vented evenly with hot, reactive gas during treatment.

The longitudinally elongated workpiece-supports 40 are straight, elongated bodies, which are arranged at right angle to the length of the rectangular frame 20. The workpiece-supports are mounted lengthwise slideably within the grating with intersecting elements having a mutually enclosing edge, said edge fastening the workpiece-supports in the vertical direction. At their respective ends, said workpiece-supports are fastened in lateral direction by a middle element on one side and a frame-element on the other side, both elements having comb-like structure and being inserted from above into the workpiece-carrier. The enclosure of intersecting elements and the endwise fastening by frame- and grating-element results in a complete fastening of all workpiece-supports within the grating. Advantageously—in case of crack or fissure—any workpiece-support can be exchanged by lateral, sliding movement after removal of one of the fastening frame-elements. This advantageous arrangement will be called a 'close-to-frame position' in the following, relating to workpiece-supports, that can be exchanged after removal of only one element of the frame.

An evenly, common plane-parallel workpiece-support-area 50 results from all workpiece-support-areas being evenly and parallely distanced above the plane of the grating. In combination with the predescribed fastening of workpiece-supports an even distribution of workpiece-supports along the grating's surface results in an advantageously dense arrangement of workpiece-supports; the illustrated arrangement will ensure a stable workpiece-support on several workpiece-support-areas, if a continuous bottom area of a workpiece equals at least 20% of the complete surface of the grating. Any automatic, rough positioning of a workpiece within the grating's surface will then lead to the desired, secure support, securely preventing direct contact of workpiece and CFC-grating.

The longitudinally elongated workpiece-supports 40 consist of single-piece, sintered alumina; said ceramic provides at most efficient ratio of costs to life-expectancy a material, which is inert to all common workpiece-materials and conditions of treatment, and will reliably keep its shape up to temperatures as high as 1900 degrees celsius. The common, continuous plane-parallel workpiece-support-area 50 will ensure a stable workpiece-position to be durable, making any later shift or twist within the workpiece-carrier irrelevant; it will not affect the treatment.

The longitudinally elongated workpiece-supports 40 have a trapezoidal cross-cut 41 with an advantageously parallel basis and symmetrical side-sections. The symmetrical side-sections prevent any wrong or mismatching insertion of workpiece-supports into the grating; furthermore the symmetrical workpiece-support allows a closer and steadier fastening via enclosing elements. In addition to this, the parallel basis in combination with a parallel, above-positioned workpiece-support-area will dissipate a load of force exerted by a workpiece much more evenly as predescribed.

In a central position in relation to the cross-cut area, said workpiece-support 40 has a continuous, longitudinal bore 42; the continuous bore results in a more evenly and homogeneously distribution of heat, especially in the case of high rates of heating or cooling.

An additionally integrated, fixing element within said longitudinal bore 42 (not depicted in FIG. 1) will—by higher, thermal conductivity of the CFC-material—increase the predescribed effect and additionally protect the longitudinally elongated workpiece-support 40 against break-away in case of fracture or fissure.

By centrosymmetrical arrangement of all close-to-frame, longitudinally elongated workpiece-supports 40 the position of all workpiece-supports 40 will always be the same after rough, automatic orientation of the frame along its width or broadth; any mismatch of arrangement of workpiece-supports is thus completely avoided, especially in combination with the fastening frame-element.

The longitudinally elongated workpiece-supports 40 of the illustrated design are arranged in continuous contact to the enclosing elements along the base of the trapezoid cross-cut. A load of force exerted from above will be dissipated evenly into the bottom-side elements via said contact, transducing the force along the enclosing elements. The enclosing edges of said elements have a distance to the workpiece-support of several percent in relation to the overall thickness of said workpiece-support, ensuring a fastened, slideable position, even if thermal expansion coefficients differ significantly; thus said workpiece-support will never get stuck or wedge itself tight within the fastening, ensuring a secure but always slightly movable workpiece-support, even if a relevant, thermal expansion due to high temperature takes place.

The distance of the fastening elements along the workpiece-support's ends is 5 to 10 percent of its total length in each case. In case of parallel orientation of all workpiece-supports 40, such allows partial compensation of impulse of same direction and ensures at the same time a secure, all-enclosing fastening. The elements 60 enclosing with a vertical edge have each two upside cut-out sections 61, neighbouring the fastened, longitudinally elongated workpiece-support 40. Within these cut-out sections transversely oriented elements 62 have been inserted form- and force-fittingly interlocking with a matching down-side cut-out section. The upside cut-out sections will transduce the weight of a supported workpiece along the whole structure of the workpiece-carrier, improving stability and capacity of the workpiece-carrier.

The illustrated embodiment is especially simple and versatile in application; the all-enclosing fastening of the workpiece-supports 40 allows furthermore the use of said workpiece-carrier as a vertical wall-element without incurring the danger of workpiece-supports 40 sliding out or breaking away, even in the case of a fracture or fissure crosswise to its elongation. Furthermore the symmetrically structured alumina workpiece-supports 40 provide in their close-to-frame position with several fastening and fixing-means a treatment of workpieces at extremely low risk, easy handling, simple and fast replaceability and optimised ratio of costs and savings.

Figure 2:
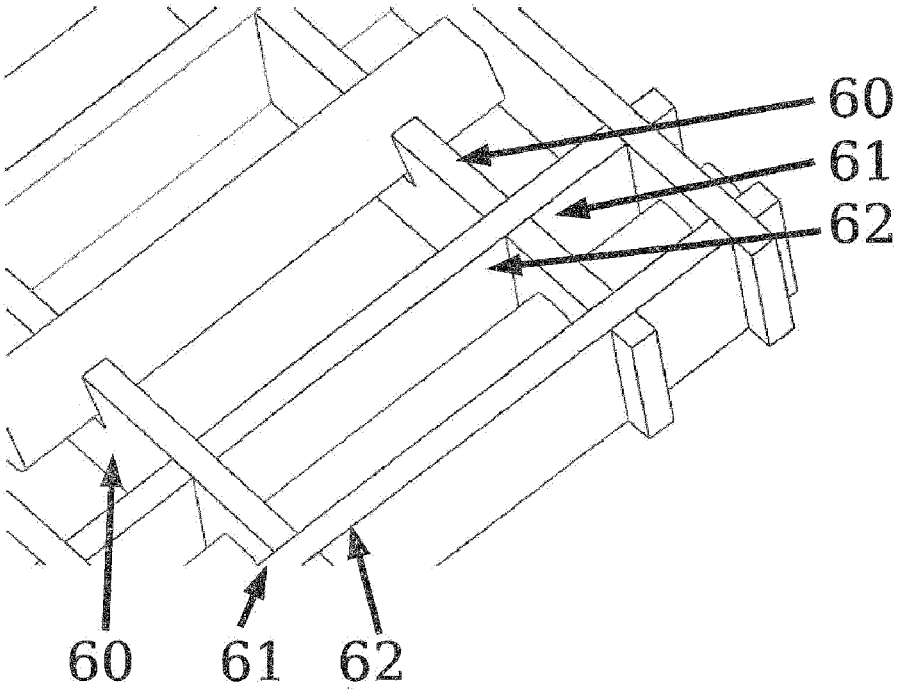

FIG. 2 shows an enlarged view of a high temperature hybrid grating according to FIG. 1. The additional auxiliary element, which is arranged within the grating neighbouring a frame-element, can be seen in more detail, being a continuous CFC-board-strip with an almost square-sized cross-cut. The auxiliary element has a cross-cut resembling a square with rounded edges and extends along the whole width of the workpiece-carrier. All length-wise oriented elements have a respective puncture, allowing the auxiliary element to pass through all these elements. Each area of puncture is respectively characterised by a form-fitting auxiliary bore. By form fittingly arranging the auxiliary element in all lengthwise oriented elements, these elements are interconnected, resulting in a workpiece-carrier, which can not be disassembled prior to removing the auxiliary element. By alternating cut-out sections of the interlocking elements the whole structure of the workpiece-carrier is thus locked, which will be designated as 'fastened in assembled position' in the following.

In order to exchange a close-to-frame workpiece-support 40 the respective frame-element has to be freed by removing all auxiliary elements. Subsequently the frame-element can be removed vertically, opening the enclosure of the respective close-to-frame workpiece-support 40. After exchanging all damaged workpiece-supports 40 the frame-element will be re-inserted and concludingly the auxiliary elements will be moved into their initial position, fastening the workpiece-carrier in assembled position.

Preferably an embodiment has two symmetrical auxiliary elements as depicted in FIG. 1, wherein all cut-out sections of lengthwise oriented elements are also symmetrically arranged in relation to their middle section. The symmetrical arrangement of cut-out sections and auxiliary bores will make a re-assembly very easy and avoid damage due to mismatch: Any frame-element will be—once one of the cut-out-sections is in interlocking orientation—in form- and force-fitting orientation for insertion, independent of the number of twists, turns and rotations, that have been carried out in the meantime.

Figure 3:
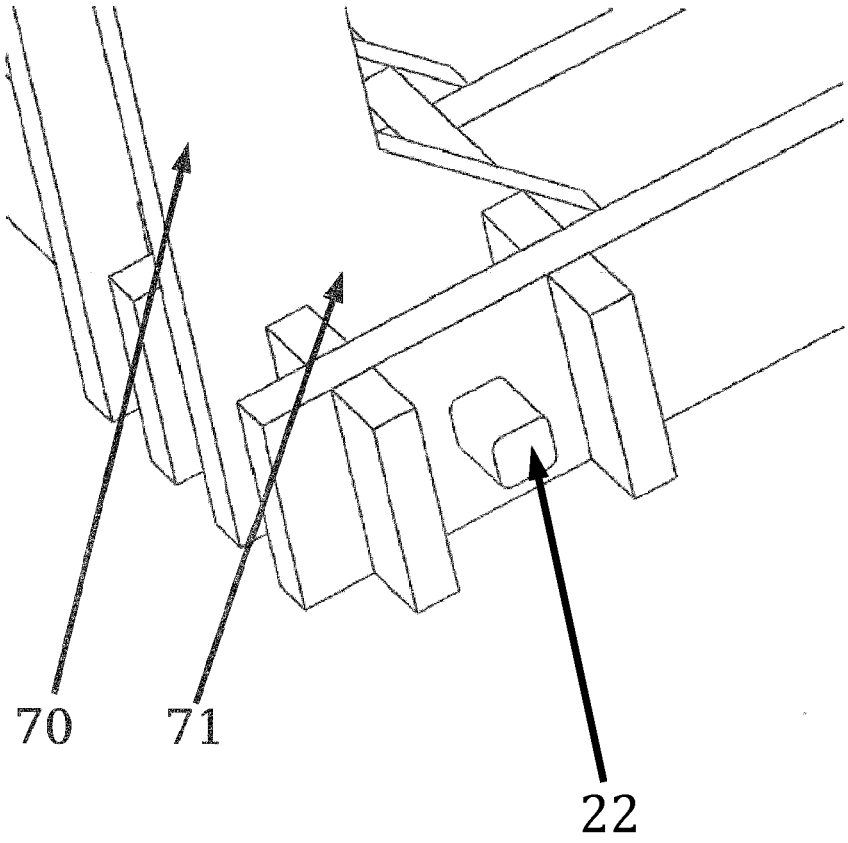
FIG. 3 a partial view of a vertically positioned element (70) having a trapezoidal base (71), which is integrated in the area of a corner of the grating FIG. 4 a partial view of a vertically positioned element (70) having a trapezoidal base (71) which is integrated in an edge-area of the grating

FIG. 3 illustrates a partial view of an advantageous workpiece-carrier, having a vertically positioned element 70 having a trapezoidal base 71, being integrated into a workpiece-carrier within a corner-area. The illustrated embodiment has a vertically positioned element 70, which has a base with downside cut-out sections, which allow integration into a transversely oriented frame-element as well as into the neighbouring, transversely oriented grating-element by form-fittingly inserting the rectangular, lower end of the trapezoidal base 71 into the workpiece-carrier. Furthermore said rectangular lower end has an auxiliary bore, which results in the vertically positioned element 70 being likewise fastened in assembled position upon insertion of the depicted auxiliary element.

In assembled position the vertically positioned element 70 has an outer edge, that has identical length to all outer edges of the parallel, inserted grating-elements, thus encompassing a frame-element and a grating-element without changing the length or width of the workpiece-carrier.

Starting from the rectangular, lower end of the trapezoidal base, the vertically positioned element 70 is reduced in broadth by the trapezoidal section, terminating in a CFC-board-strip of constant but reduced width shortly above the plane of the grating. The slope of the right-angled trapezoid section is directed towards the middle section of the workpiece-carrier, i. e. the outer edge of the vertically positioned element 70 provides a continuous, vertical, outer edge of the workpiece-carrier. The predescribed, trapezoidal contour of the lower, integrated end of such an element allows a very cost-saving production of such elements, if the rectangular, lower end is twice as broad as the above CFC-board-strip: Two such strips can be cut from one strip of double broadth within one cutting operation.

The form-fitting integration via at least two cut-out sections in combination with the element being fastened in assembled position by an auxiliary element provides a stable and secure fastening of the vertical positioned element 70 within the workpiece-carrier. Thus-fastened elements allow the assembly of an equally stable, vertical grating, which in turn allows several workpiece-carriers to be arranged on top of each other within a larger matrix. The load of forces is transduced evenly via the predescribed integrating base-structures along the structure of the workpiece-carriers.

Figure 4:
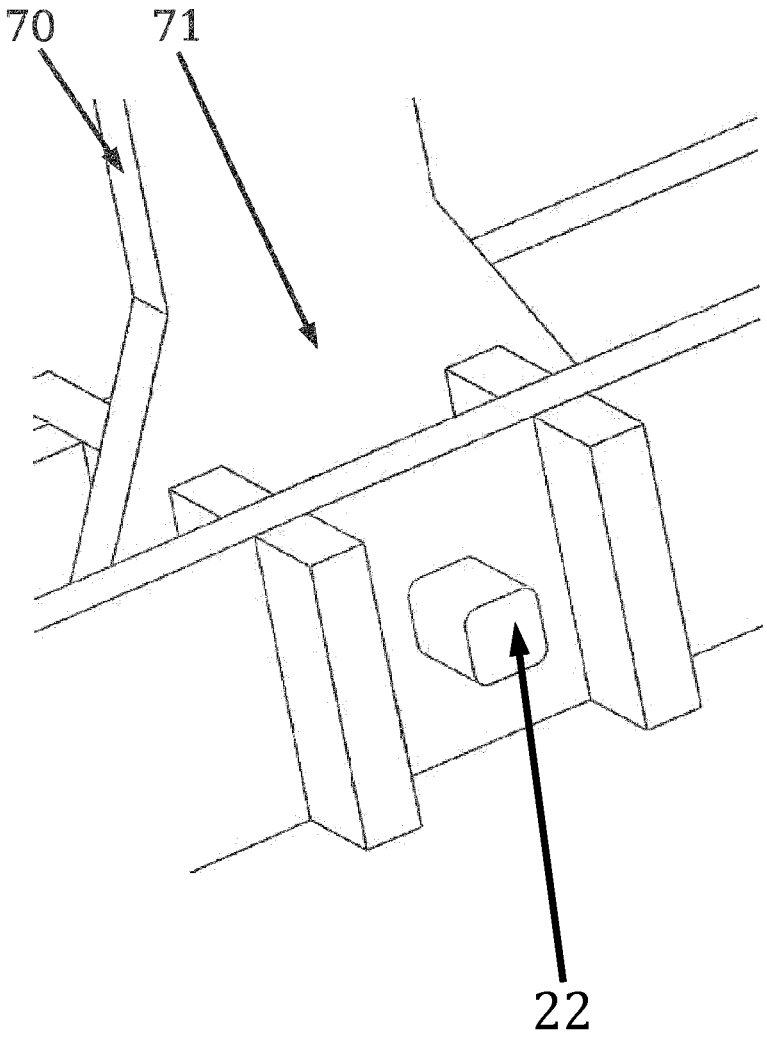
Figure 5:
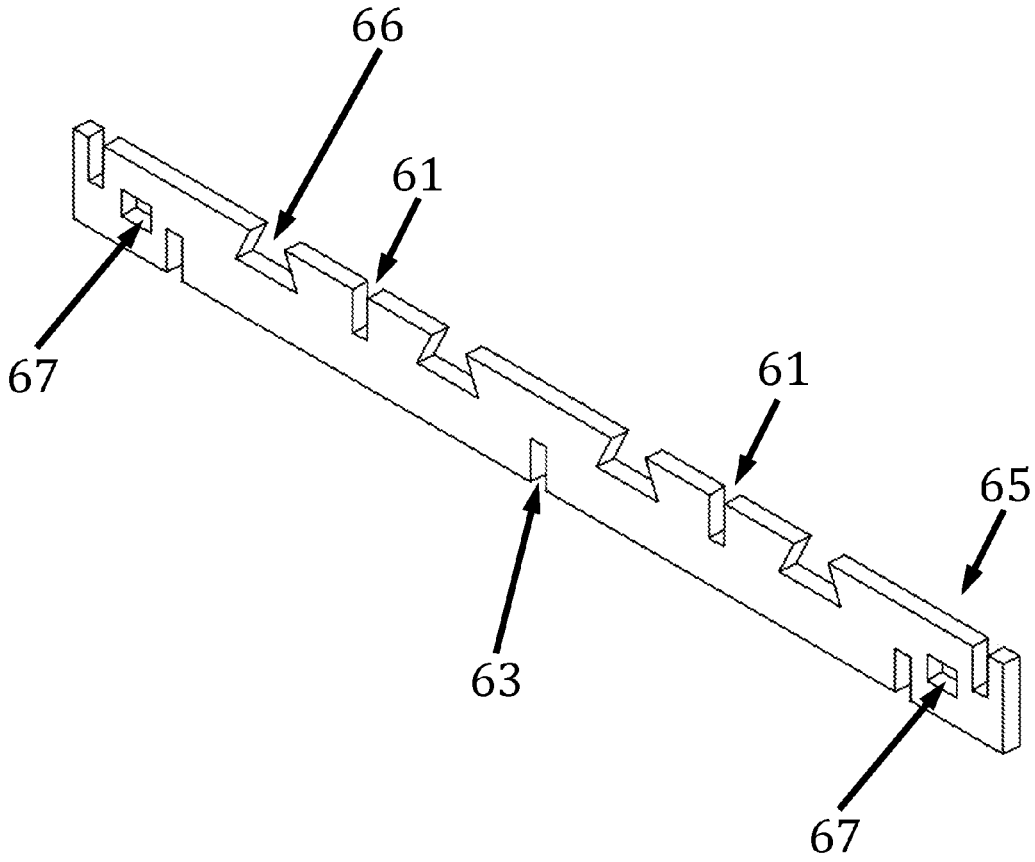
FIG. 5 shows a grating-element (65) having enclosing cut-out-sections (66), auxiliary bores (67), and interlocking cut-out-sections which include up-side cut-out-sections (61) and down-side cut-out-sections (63).
Figure 6:
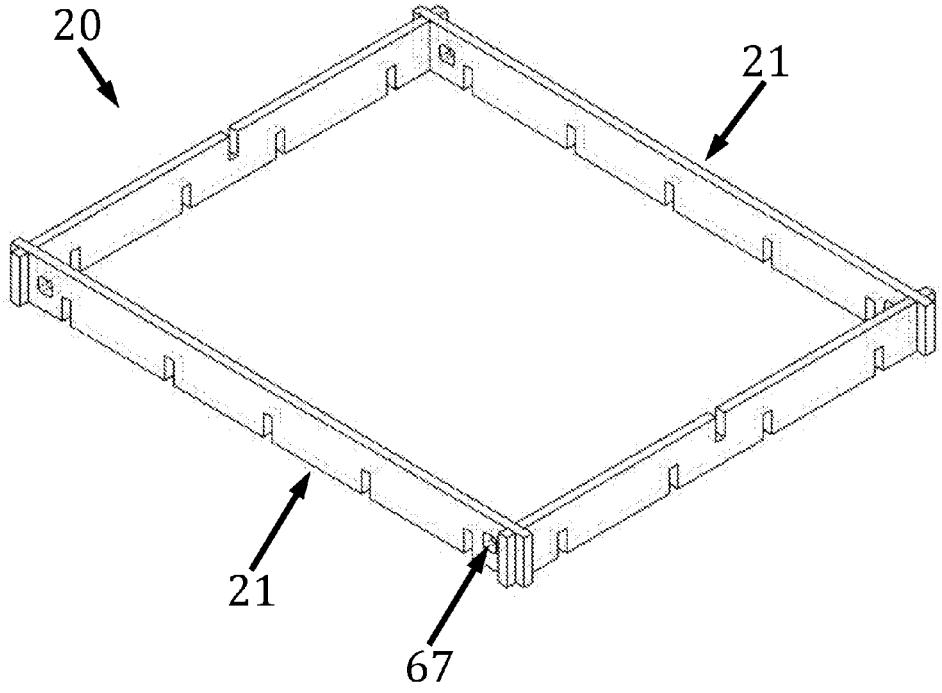
FIG. 6 shows a rectangular frame (20) comprising frame-elements that are comb-shaped elements (21).
Figure 7:
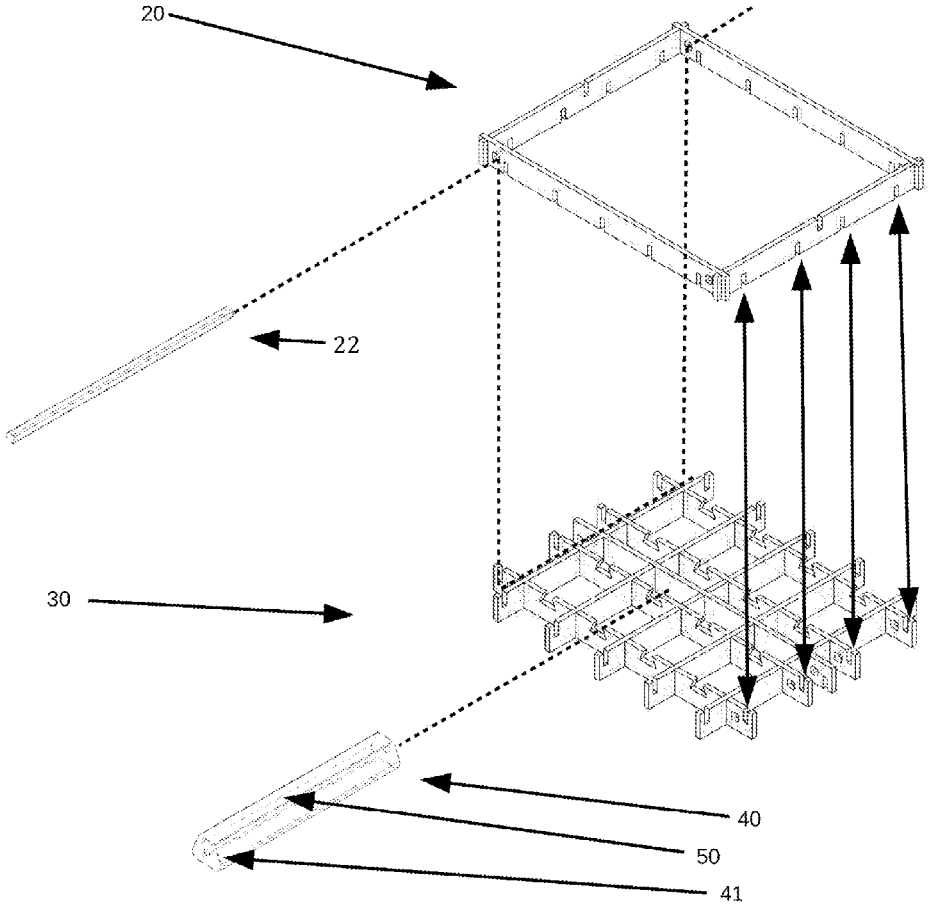
FIG. 7 shows an exploded view of the workpiece-carrier comprising the frame (20), the grating (30), the auxiliary element (22), and the workpiece-support (40).

FIG. 4 demonstrates a partial view of a vertically positioned element 70 having a trapezoidal base 71, in a position close to an edge of a workpiece-carrier. Differing from the predescribed integration in a corner-area, the vertically positioned element 70 has now a symmetrically shaped, lower end, having a trapezoidal section with steeper, symmetrical slopes on both sides. Furthermore the vertically positioned element 70 encompasses in such a position at least two transversely oriented grating-elements via interlocking, downside cut-out sections. As explained previously at least two down-side cut-out sections, combined with an auxiliary bore and an inserted auxiliary element, provide a secure and stable integration into the workpiece-carrier.

INDUSTRIAL APPLICABILITY

The inventive, claimed workpiece-carrier is the first to provide a continuous, force-transducing assembly that will stay in assembled position even if subjected to automatic handling with intermittent arrangement in an overhead-position. It allows industrial, automatic handling while additionally reducing costs of use due to the separately exchangeable parts. Advantageous features and embodiments allow further reduction of costs of use/application, while increasing the quality and ease of handling of the workpiece-carrier, providing a further improved quality of treated work-pieces.

The invention claimed is:

1. A workpiece-carrier in the form of a high-temperature-grating assembled from elements, said elements being carbon-fibre-reinforced carbon-composite-board-strips being panel-shaped and comprising frame-elements and grating elements, said frame-elements comprising two comb-shaped frame-elements and two additional frame-elements; each of said grating-elements comprising two frame-engaging slots located at either end of a length of the each of said grating elements and a plurality of grating-engaging slots; each of said two comb-shaped frame-elements having two downward-facing frame-engaging slots located at either end of a length of the each of said two comb-shaped frame-elements, two auxiliary bores located at either end of the length of the each of said two comb-shaped frame-elements, and a plurality of downward-facing grating-engaging slots; each of said two additional frame-elements comprising two upward-facing frame-engaging slots located at either end of a length of the each of said two additional frame-elements, a plurality of downward-facing grating-engaging slots, and at least one upward-facing grating-engaging slot; the workpiece-carrier having a frame and a horizontal grating; said frame being provided by mutually engaging said frame-elements, wherein each of the downward-facing frame-engaging slots of said two comb-shaped frame-elements interfaces with one of the upward-facing frame-engaging slots of said two additional frame-elements, and said frame has said plurality of downward-facing grating-engaging slots and said at least two upward-facing grating-engaging slots; said grating being provided by mutually engaging said grating-elements, wherein said grating-elements cross each other at the grating-engaging slots of said grating-elements, and said grating has a plurality of upward-facing frame-engaging slots and at least two downward-facing frame-engaging slots; said plurality of upward-facing frame-engaging slots of said grating interface with said plurality of downward-facing grating-engaging slots of said frame and said two downward-facing frame-engaging slots of said grating interface with said two upward-facing grating-engaging slots of said frame to fix said grating to said frame; at least one of said grating-elements comprising an upward-facing enclosing cut-out-section; the workpiece-carrier further comprising at least one workpiece-support which is inert in relation to the supported workpiece and provides a workpiece-support-area at a distance above said grating, said workpiece-support being arranged within said upward-facing enclosing cut-out-section; wherein: said grating-elements comprise at least one interlocking element, said interlocking element comprises at least one auxiliary bore located at one end of a length of said interlocking element and interlocking slots, said interlocking slots comprises upward-facing grating-engaging slots and downward-facing grating-engaging slots disposed in an alternate arrangement; the workpiece-carrier further comprises at least one auxiliary element; said workpiece-support is a single-piece part of ceramic of rod-shaped elongation, said elongation being arranged parallel to the plane of said grating, said workpiece-support being an integral part of said grating by being enclosed in upward-facing enclosing cut-out-sections of a multitude of crosswise arranged grating-elements while also being framed at its ends of said workpiece-support by crosswise arranged continuous elements, the enclosed, non-removable workpiece-support being floatingly integrated within said grating; the workpiece-carrier being fastened in assembled position by the at least one auxiliary element, wherein each comb-shaped frame-element has at least one of the two auxiliary bores having said auxiliary element arranged tightly and form-fittingly in said at least one of the two auxiliary bores of said comb-shaped frame-elements and said auxiliary element being furthermore arranged tightly and form-fittingly in said auxiliary bore of said interlocking element having interlocking slots in the alternate arrangement.

2. The workpiece-carrier of claim 1, wherein the workpiece-carrier has a rectangular frame, and workpiece-supports are centrosymmetrically arranged within said frame.

3. The workpiece-carrier of claim 1, wherein each of said elements has transverse sides, and the transverse sides of all elements within said grating of the workpiece-carrier are arranged in an orientation perpendicular to the plane of said grating, providing a grating of crossing edges within said frame.

4. The workpiece-carrier of claim 1, wherein at least one auxiliary element is at least as long as one horizontal diameter of the workpiece-carrier and is arranged across said diameter tightly and form-fittingly in the auxiliary bores.

5. The workpiece-carrier of claim 1, wherein at least two auxiliary elements are at least as long as the horizontal width of the workpiece-carrier and are arranged across said width tightly and form-fittingly in the auxiliary bores, securing each comb-shaped element via two auxiliary bores arranged symmetrically at opposing ends of said comb-shaped elements.

6. The workpiece-carrier of claim 1, wherein at least one element, preferably an element of the frame, has in a downside-area relative to the grating a cut-out engagement-section in essentially parallel orientation to the plane of said grating.

7. The workpiece-carrier of claim 1, wherein vertically positioned, mutually engaging elements are integrated at least into the grating, said elements provide at least one vertically positioned frame, preferably at least one vertically positioned frame with a vertically positioned grating arranged within, especially preferred with additionally integrally fixed, floatingly mounted single-piece high temperature ceramic workpiece-supports in vertical orientation providing prop-up-elements.

8. The workpiece-carrier of claim 1, wherein said interlocking element has a downward-facing slot and at least two upward-facing slots neighbouring the downward-facing slot, each of the upward-facing slots is arranged in mutual engagement with a form- and force-fittingly, transversely oriented element having a downward-facing slot.

9. The workpiece-carrier of claim 1, wherein the dimension of said upward-facing enclosing cut-out-section is equal to the thermally expanded dimension of the enclosed workpiece-support under high-temperature conditions.

10. The workpiece-carrier of claim 1, wherein at least one workpiece-support has a trapezoidal cross-cut and the base of said trapezoid is positioned parallel to the plane of the grating with continuous contact to the plurality of elements.

11. The workpiece-carrier of claim 1, wherein at least one workpiece-support is arranged so as to provide in a cross-cut-view an upper surface parallel to the horizontal plane of the grating, providing a workpiece-support-area in plane-parallel orientation to the plane of the grating.

12. The workpiece-carrier of claim 1, wherein at least one workpiece-support consists of a ceramic-based compound and the workpiece-support-area consists of one single compound.

13. The workpiece-carrier of claim 1, wherein at least one workpiece-support has a central, continuous, longitudinal bore in parallel position to the workpiece-support-area and an additional element of the workpiece-carrier is arranged in a fixing position.

14. The workpiece-carrier of claim 1, wherein the workpiece-carrier has as a plurality of workpiece-supports providing a continuous array of workpiece-support-areas at an upside-distance to the grating, furthermore the longitudinally elongated workpiece-supports are an integral, floatingly mounted part of the grating and provide a plane-parallel workpiece-support-area, the workpiece-supports are rod-shaped and have an equal length and a trapezoidal cross-cut with symmetrical side-sections and rounded edges, the workpiece-supports further have a central, continuous, longitudinal bore, an element is arranged crosswise to a multitude of parallel elements, said elements having vertical edges, which mutually enclose the workpiece-supports below the workpiece-support-area with continuous contact to the group of parallel elements along their bottom-surface at a distance to the adjacent, crosswise oriented, framing elements, the elements having an enclosing, vertical edge, at least one of said grating-elements has two upward-facing grating-engaging slots, each of two upward-facing grating-engaging slots has a form-fitting and force-fitting, mutually engagement with a transversely positioned grating-element, each form-fitting and force-fitting, mutually engaging, transversely positioned grating-element has a downward-facing grating-engaging slot, at least one vertically positioned element providing a vertical frame integrates into the grating at least via a trapezoidal base, and the vertically positioned element has at least two downward-facing element-engaging cut-out sections engaging with one of said grating-elements and one of said two additional frame-elements, and the vertically positioned element further comprises an auxiliary bore.

15. The workpiece-carrier of claim 1, wherein the elements consist of carbon fiber reinforced carbon composite board strips, the carbon fiber reinforced carbon composite board strips have at least one fabric consisting of carbon fiber-rovings, said fabric has linen weave having a thickness of fiber of from 3 to 10 micrometers and providing a fabric-area having square delimitation of up-weave and down-weave of the rovings arranged at essentially right angles to each other, the elements have dry-machined edges being parallel to the direction of warp-rovings and having an accuracy of ±20 micrometers, the dry-machined upward-facing enclosing cut-out sections and slots have brush-like edges at an accuracy of ±20 micrometers, and said upward-facing enclosing cut-out sections and slots have a depth relative to the size of square provided by the fabric of at least (depth: length of square-side)=1.4:1.

16. The workpiece-carrier of claim 1, wherein said workpiece-support comprises high temperature ceramic.

17. A workpiece-carrier, comprising:

a frame, the frame comprising two comb-shaped frame-elements and two additional frame-elements, each of the two comb-shaped frame-elements comprising two downward-facing frame-engaging slots located at either end of a length of the each of the two comb-shaped elements, at least one frame auxiliary bore located at one end of the length of the each of the two comb-shaped elements, and a plurality of downward-facing grating-engaging slots; and the two additional frame-elements comprising two upward-facing frame-engaging slots located at either end of a length of the each of the two additional frame-elements, at least one upward-facing grating-engaging slot, and a plurality of downward-facing grating-engaging slots;

a grating, the grating comprising grating-elements, each of the grating-elements comprising two frame-engaging slots located at either end of a length of the each of the grating-elements and a plurality of grating-engaging slots; at least one of the grating-elements having at least one grating auxiliary bore located at one end of a length of the at least one of the grating-elements and at least one upward-facing enclosing cut-out-section, the upward-facing enclosing cut-out-section having a depth; and at least one of the grating-elements being an interlocking element, the interlocking element having at least one interlocking auxiliary bore and having upward-facing grating-engaging slots and downward-facing grating-engaging slots disposed in an alternate arrangement;

at least one rod-shaped workpiece-support for supporting workpieces, the rod-shaped workpiece-support being a single-piece part of ceramic and having a planar base, a planar top, and a height, the height being longer than the depth; and at least one auxiliary element;

wherein:

the frame-elements and the grating-elements comprise carbon-fiber reinforced carbon composite;

the rod-shaped workpiece-support comprises material inert to workpieces accommodated in the workpiece-carrier;

the downward-facing frame-engaging slots of the two comb-shaped frame-elements interface with the upward-facing frame-engaging slots of the two additional frame-elements form the frame comprising said plurality of downward-facing grating-engaging slots and said at least two upward-facing grating-engaging slots;

the grating-engaging slots of the grating-elements interface with each other to form the grating comprising said plurality of upward-facing framing-engaging slots and said at least two downward-facing framing-engaging slots;

the plurality of upward-facing framing-engaging slots and the two downward-facing framing-engaging slots of the grating interface with the plurality of downward-facing grating-engaging slots and the two upward-facing grating-engaging slots of the frame to fix the grating to the frame, wherein the grating and the frame form a grid-shaped plate having compartments, each of the compartment is in a rectangular shape, and the frame auxiliary bore, the grating auxiliary bore, and the interlocking auxiliary bore are aligned along a line;

the planar base is disposed in the upward-facing enclosing cut-out-section, wherein the planar top forms a workpiece-support-area being parallel to and at a distance away from a plane of said grid-shaped plate and the rod-shaped workpiece-support floatingly integrates within the grating and is disposed across one of the compartments; and the auxiliary element is disposed in the frame auxiliary bore, in the grating auxiliary bore, and in the interlocking auxiliary bore whereby locking the frame to the grating.

18. A workpiece-carrier, comprising:

rod-shaped workpiece-supports, each of the rod-shaped workpiece-supports being a single-piece part of ceramic and having a trapezoidal cross section, a planar base, and a planar top, the trapezoidal cross section having a height, the planar base having a base width, the planar top having a top width, and the base width being longer than the top width;

a rectangular frame, the rectangular frame comprising a first group of frame strips and a second group of frame strips;

each of the first group of frame strips being comb-shaped and having two downward-facing frame-engaging slots located at either end of a length of the each of the first group of frame strips, two frame auxiliary bores located at either end of the length of the each of the first group of frame strips, and a plurality of downward-facing grating-engaging slots; and each of the second group of frame strips having two upward-facing frame-engaging slots located at either end of a length of the each of the second group of frame strips, one upward-facing grating-engaging slot, and a plurality of downward-facing grating-engaging slots;

a grating, the grating comprising a middle strip, a first group of grating strips, and a second group of grating strips;

the middle strip being comb-shaped and having two downward-facing frame-engaging slots located at either end of a length of the middle strip, two middle strip auxiliary bores located at either end of the length of the middle strip, and a plurality of downward-facing grating-engaging slots; each of the first group of grating strips having two upward-facing frame-engaging slots located at either end of a length of the each of the first group of grating strips, two grating auxiliary bores located at either end of the length of the each of the first group of grating strips, a plurality of grating-engaging slots, and at least one upward-facing enclosing cut-out-section; the upward-facing enclosing cut-out-section having a depth, the depth being shorter than the height; at least one of the first group of grating strips being an interlocking strip, the interlocking strip having upward-facing grating-engaging slots and downward-facing grating-engaging slots disposed in an alternate arrangement; and each of the second group of grating strips having two upward-facing frame-engaging slots located at either end of a length of the each of the second group of grating strips and a plurality of grating-engaging slots; and two auxiliary elements, the auxiliary elements being rod-shaped;

wherein:

the first group of frame strips, the second group of frame strips, the first group of grating strips, the second group of grating strips, and the middle strip comprise carbon-fiber reinforced carbon composite;

the downward-facing frame-engaging slots of the first group of frame strips interface with the upward-facing frame-engaging slots of the second group of frame strips to form the rectangular frame comprising said plurality of downward-facing grating-engaging slots and said two upward-facing grating-engaging slots, wherein the first group of frame strips is perpendicular to the second group of frame strips;

the plurality of grating-engaging slots of the first group of grating strips, the plurality of grating-engaging slots of the second group of grating strips, and the plurality of downward-facing grating-engaging slots of the middle strip interface with each other to form the grating comprising said plurality of upward-facing framing-engaging slots and said two downward-facing framing-engaging slots, wherein the middle strip is parallel to the first group of grating strips and is disposed between two of the first group of grating strips;

the plurality of upward-facing framing-engaging slots and the two downward-facing framing-engaging slots of the grating interface with the plurality of downward-facing grating-engaging slots and the two upward-facing grating-engaging slots of the rectangular frame to fix the grating to the rectangular frame to form a grating plate, wherein the first group of grafting strips is parallel to the first group of frame strips, the second group of grafting strips is parallel to the second group of frame strips, one of the two grating auxiliary bores, one of the two frame auxiliary bores, and one of the two middle strip auxiliary bores are aligned along a first line located at one end of the length of the first group of frame strips, and the other one of the two grating auxiliary bores, the other one of the two frame auxiliary bores, and the other one of the two middle strip auxiliary bores are aligned along a second line located at the other end of the length of the first group of frame strips;

one of the two auxiliary elements is disposed through one of the two grating auxiliary bores, one of the two frame auxiliary bores, and one of the two middle strip auxiliary bores aligned along the first line;

the other one of the two auxiliary elements is disposed through the other one of the two grating auxiliary bores, the other one of the two frame auxiliary bores, and the other one of the two middle strip auxiliary bores aligned along the second line;

the planar base is disposed in the upward-facing enclosing cut-out-section, wherein the rod-shaped workpiece-supports are arranged parallel to the second group of frame strips and floatingly integrate within the grating and between the middle strip and one of the first group of frame strips;

the planar top forms a workpiece-support-area; and the workpiece-support-area is parallel to and at a distance away from a plane of the grating plate.

19. The workpiece-carrier of claim 18, wherein:

the workpiece-carrier further comprises at least one additional grating;

the additional grating has an additional grating plate and at least one additional workpiece-support;

the additional grating is connected to the grating; and the additional grating plate is arranged vertical to the grating plate.

* * * * *